US008878433B1

(12) United States Patent
Fleming et al.

(10) Patent No.: US 8,878,433 B1
(45) Date of Patent: Nov. 4, 2014

(54) HIGH EFFICIENCY, LOW VOLTAGE, LOW L-BAND, MEGA-WATT CLASS MAGNETRON

(75) Inventors: Timothy Paul Fleming, Edgewood, NM (US); Michael Raymond Lambrecht, Albuquerque, NM (US); Peter Jerome Mardahl, Albuquerque, NM (US); John Davis Keisling, Belen, NM (US)

(73) Assignee: The United States of America as Represented by the Secretary of the Air Force, Washington, DC (US)

( * ) Notice: Subject to any disclaimer, the term of this patent is extended or adjusted under 35 U.S.C. 154(b) by 252 days.

(21) Appl. No.: 13/620,640

(22) Filed: Sep. 14, 2012

(51) Int. Cl.
*H01J 25/50* (2006.01)
*H01J 23/36* (2006.01)

(52) U.S. Cl.
USPC ..... 315/39.3; 315/39.51; 315/39.75

(58) Field of Classification Search
USPC ..... 315/39.3, 39.51, 39.53, 39.75, 39.67
See application file for complete search history.

(56) References Cited

U.S. PATENT DOCUMENTS

| | | | | |
|---|---|---|---|---|
| 4,169,987 | A * | 10/1979 | Oguro et al. | 315/39.51 |
| 6,643,472 | B1 | 11/2003 | Sakamoto et al. | |
| 6,653,788 | B2 * | 11/2003 | Ogura et al. | 315/39.51 |
| 2002/0043937 | A1 * | 4/2002 | Ogura et al. | 315/39.51 |

OTHER PUBLICATIONS

Wynn et al., "Development of a 300 kW CW L-Band Industrial Heating Magnetron", IEEE Transactions (2004), pp. 164, 165.
Twisleton, "Twenty-kilowatt 890 Mc/s continuous-wave magnetron", Proceedings of the IEEE, vol. 111, No. 1 (Jan. 1964), pp. 51-56.
Andreev et al., "Particle-in-Cell (PIC) Simulation if CW Industrial Heating Magnetron", Journ. Microwave Power and Electromagnetic Energy, vol. 44, No. 2 (2010), pp. 114-124.

* cited by examiner

*Primary Examiner* — Daniel D Chang
(74) *Attorney, Agent, or Firm* — James M. Skorich

(57) ABSTRACT

A conventional (non-relativistic) magnetron provides mega-watt-levels of power. The magnetron includes a fourteen vane slow wave structure that surrounds a fourteen turn helical cathode. An upstream coaxial waveguide is surrounded by a dish-shaped flange that accommodates a reflector chamber in communication with an upstream void and a downstream interaction chamber. The vanes of the slow wave structure are shaped to define fourteen resonant chambers therebetween with each of the resonant cavities having a wedge portion in communication with a neck portion.

7 Claims, 5 Drawing Sheets

HIGH EFFICIENCY, LOW VOLTAGE, LOW L-BAND, MEGA-WATT CLASS MAGNETRON

GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND OF THE INVENTION

1. Technical Field

The present invention relates to magnetrons. More particularly, this invention pertains to a compact conventional (non-relativistic) magnetron suitable for numerous military and industrial applications.

2. Background Art

The magnetron is a crossed-field device in which electric fields (RF and d.c.) are perpendicular to a static magnetic field. It is recognized that numerous military and industrial applications exist for employing such a device capable of generating more than 1 Mega-watt of RF power near L-band with efficiencies of 85 percent or more.

Current commercially available magnetrons suitable for use in such critical military applications as providing countermeasures for improvised explosive devices are singularly inadequate for high microwave power (more than 1 Megawatt RF output) at near L-band operation. For example, the 100L (L-3 Communications Electron Devices, California Tube Laboratory) is capable of only 100 kilowatt RF output near L-band at 88 percent efficiency. Another device, a 300L magnetron, is described by Wynn et al. in an article entitled "Development of a 300 kW CW L-band Industrial Heating Magnetron". The 300L magnetron is capable of producing approximately 300 kilowatt RF near L-band (915 MHz).

Presently, no conventional magnetron (input voltage less than 100 kV) is capable of producing more than 1 megawatt of output power, near L-band (approximately 912 MHz) for diode voltages at or less than 45 kV with efficiencies exceeding 85 percent.

SUMMARY AND OBJECTS OF THE INVENTION

It is therefore an object of the present invention to provide a non-relativistic magnetron capable of generating greater than 1 Mega-watt of RF output power near L-band.

It is another object of the invention to accomplish the foregoing object at relatively low input voltage with a magnetron of compact design.

The present invention addresses shortcomings of the prior art by providing a magnetron for delivering mega-watt power at a non-relativistic diode voltage. Such magnetron includes an upstream coaxial waveguide comprising a central core and a surrounding exterior layer separated by an annular void defining an upstream chamber. The waveguide is electrically coupled to an adjoining downstream slow wave structure.

The slow wave structure includes a rod-shaped central supporting cylinder. A helical cathode comprises fourteen turns and is coaxial with the supporting cylinder. An anode slow wave structure is coaxial with and surrounds the support and the cylinder and is separated by a void defining a downstream interaction region.

The anode structure comprises fourteen interiorly-directed vanes separating and defining fourteen resonance cavities. Each of the cavities comprises a wedge portion adjoined to a neck portion.

The preceding and other features of the invention are described in the written description that follows. Such description is accompanied by a set of drawing figures. Numerals of the drawing figures, corresponding to those of the written description, point to the features of the invention. Like numerals refer to like features throughout both the written description and the drawings.

DETAILED DESCRIPTION

The present invention will be seen to provide a magnetron capable of providing megawatt power at conventional, non-relativistic diode voltages (less than 100 kV). Previously, the design of a magnetron capable of such performance was hindered by perceived difficulties. Concern about (breakdown) axial field stresses upon straps added to anode vanes for purposes of mode separation. An additional concern has centered about the issue of heating of the cathode. As described below, the inventors have designed a magnetron that offers architecture capable of sustaining the perceived stresses and heating to accomplish megawatt power outputs at conventional diode voltages. Simulations based upon such architecture are discussed to prove the efficacy of the inventors' magnetron design.

Figure 1:
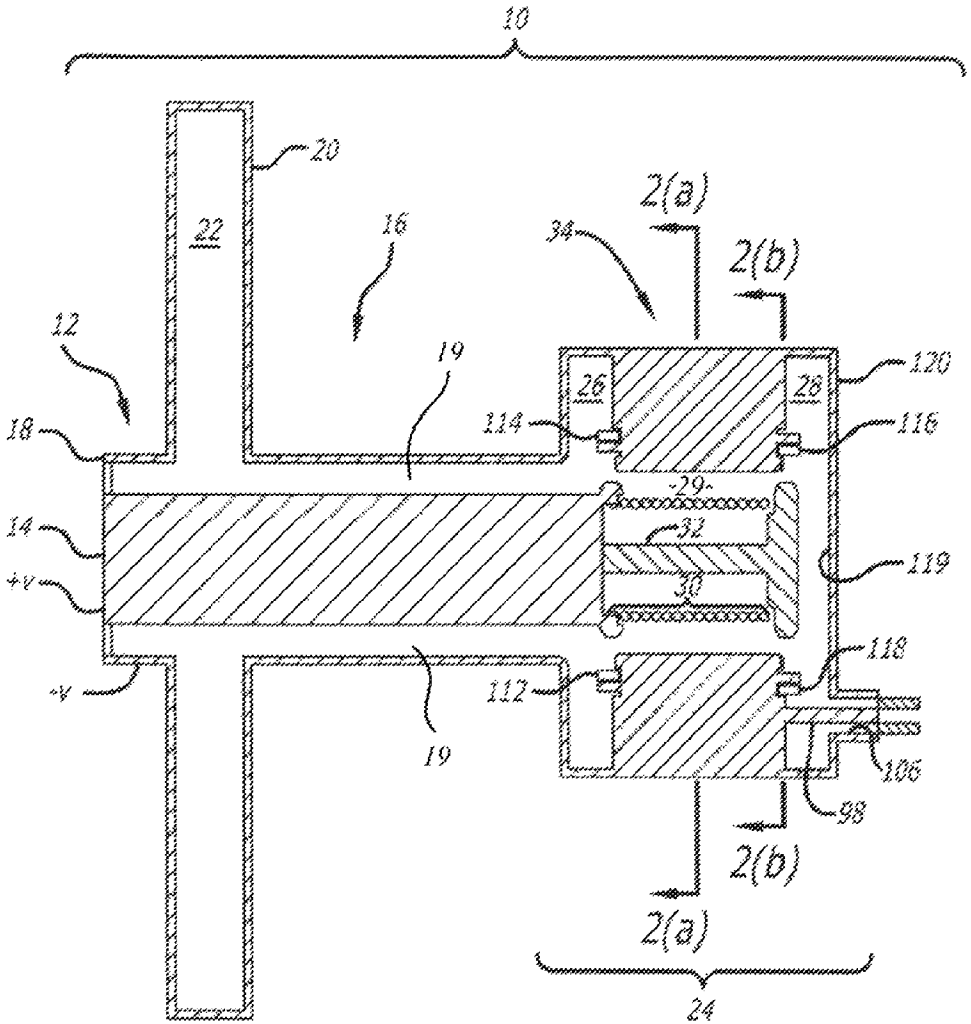
FIG. 1 is a side sectional view of a magnetron in accordance with the invention.

Turning now to the drawings, FIG. 1 is a side sectional view of a magnetron 10 in accordance with the invention. A voltage potential can be applied at an upstream end 12 that communicates with a coaxial waveguide 16 having a cylindrical core 14, preferably of copper or stainless steel and an exterior layer 18 separated by an annular upstream chamber 19. The layer 18, conductively coupled to a downstream anode slow wave structure (discussed infra), is electrically insulated from the core 14 which is conductively connected to a helical cathode (discussed infra) so that the potential difference applied at the upstream end 12 is transmitted to and serves as the diode voltage of the magnetron 10.

A disk-shaped flange 20 surrounds a portion of the coaxial waveguide 16. Such flange 20 accommodates an interior reflector chamber 22 of like shape that is located and dimensioned to act as a reflector of r.f. energy, whereby energy is prevented from reflection out of the upstream end 12 of the magnetron 10, and guided to propagate toward a downstream slow wave structure 24. The downstream slow wave structure 24 includes chambers that communicate with the annular upstream chamber 19 including an upstream end cap chamber 26 and a downstream end cap chamber 28 separated by the interaction region 29.

Figure 2A:
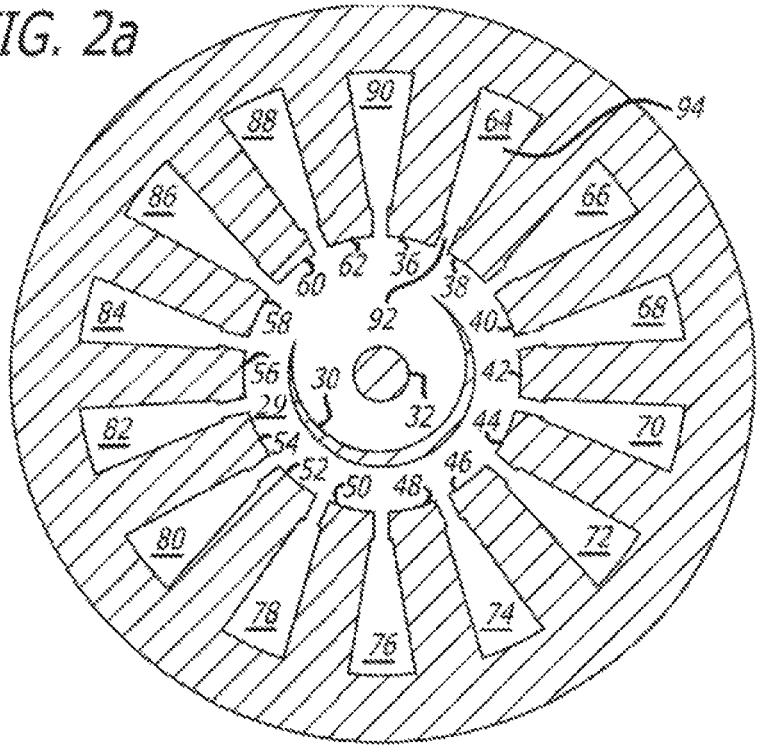
FIGS. 2(*a*) and 2(*b*) are cross-sectional views of the magnetron of FIG. 1 taken at section lines 2(*a*)-2(*a*) and 2(*b*)-2(*b*) respectively.
Figure 2B:
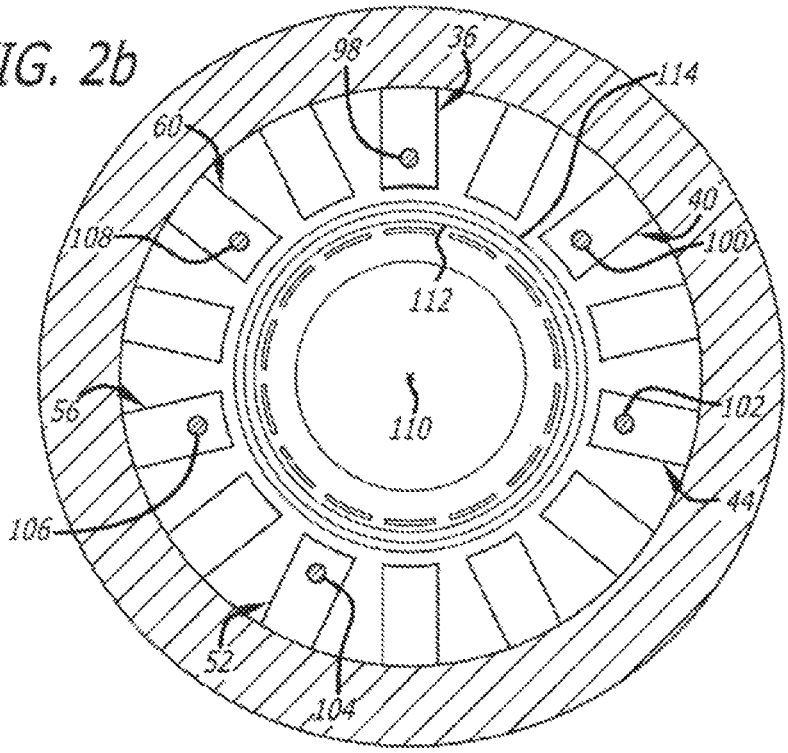

FIGS. 2(*a*) and 2(*b*) are cross-sectional views of the magnetron 10 of FIG. 1 taken at section lines 2(*a*)-2(*a*) and 2(*b*)-2(*b*) respectively. Referring to the views of FIGS. 1, 2(*a*) and 2(*b*) in combination, a charged particle emitting cathode 30 comprises a helical structure consisting of fourteen turns that is capable of emitting charged particles (thermionic emission) over its entire surface. Such cathode 30 surrounds a central support cylinder 32.

A virtual prototype of the magnetron 10 was configured for a performance simulation, discussed below, having the following parameters: cathode radii (major radius 2.2 cm; minor radius (i.e. cross-sectional radius) 0.386 cm); distance between cathode and center support cylinder (1.2 cm); and radius of center support cylinder (0.64 cm).

An anode slow wave structure 34 surrounds the helical cathode 30. The slow wave structure 34 consists of fourteen (14) vanes 36 through 62 that define fourteen (14) resonant cavities 64 through 90. The fourteen resonant cavities 64 through 90 serve to reduce the phase velocity of the RF modes in the cavity. Each cavity of the slow wave structure consists of two parts. Taking the cavity 64 as representative, a first part, a neck 92 has a generally square shape while a second part, comprises a wedge 94.

Again referring to a virtual prototype of the invention employed for the simulation to be discussed below, the following dimensions were employed to define the anode slow wave structure: radius of slow wave structure (3 cm); radial length of a neck (0.61 cm, extending from a radius of 3.04 cm to 3.65 cm); azimuthal length of a neck (0.35 cm); wedge radius (6.76 cm), angle (22.16 degrees).

A uniform axial magnetic field prevents charged particles from immediately accelerating across the interaction region 29. Rather, such particles undergo rotations about the cathode 30. If the particles' azimuthal velocity component is approximately to the phase velocity of a particular electromagnetic mode in the interaction region 29 then the possibility exists for energy exchange between the particle and the mode. Such resonance is known as the Buneman-Hartee resonance condition. As the particles rotate about the cathode 30 they gradually give up their potential energy to a mode or modes of the RF field as they migrate toward the anode slow wave structure 34. This is how RF oscillations are initiated in the magnetron 10.

FIGS. 1 and 2(*b*) in combination illustrate the RF extraction mechanism of the magnetron 10. Such extraction mechanism comprises six coaxial waveguides provided on the downstream end of the anode slow wave structure 34. The waveguides 98 through 108 are fixed to the downstream edges of (proceeding clockwise from the top of FIGS. 2(*a*) and 2(*b*)) the first, third, fifth, seventh, ninth and eleventh vanes 36, 40, 44, 52, 56 and 60 respectively. In the simulation of the magnetron 10 discussed below, the projected center axes of the waveguides 98 through 108 were located a distance of 5 cm from the center axis 110 of the magnetron 10. The cylinder of a waveguide 98, 100, 102, 104, 106, 108 was modeled to have a radius of 0.23 cm while the outer radius of an extractor (e.g. the extractor 106 of FIG. 1 which receives the waveguide 98) was modeled to have a radius of 0.65 cm.

FIGS. 1 and 2(*b*) in combination additionally illustrate straps 112 through 118 attached to the upstream and downstream ends of the slow wave anode structure 34 on alternating vanes. The straps are in place to create sufficient mode separation between the dominant π mode and the competing n−1 mode. Strap radii are measured from the center axis 110 of the magnetron 10. The inner strap 112 (referring to the upstream end of the slow wave anode structure 34) radius was modeled at 3.57 cm while the outer strap 110 radius was modeled at 4.0 cm. Radial strap thicknesses were modeled at 0.23 cm and strap separations at 0.19 cm.

Referring specifically to FIG. 1, the straps 112 through 118 are run through trenches of the anode vanes that are modeled at a distance of 0.2 cm above the ends of the anode vanes. The axial length of the cathode 30 was modeled to be 8.4 cm with a periodicity between the fourteen turns of the helical cathode being modeled to be 0.2 cm.

The entire axial length of the magnetron 10 (from left boundary of the cylindrical core 14 to the inner surface 119 of the downstream wall 120 was modeled at 36.7 cm with the interior chamber 22 that serves as an RF energy reflector located at a distance of 3.27 cm from the upstream end of the magnetron 10 and a distance of 16.4 cm from the upstream end cap chamber 26.

A simulation was conducted of a magnetron 10 in accordance with the invention utilizing design parameters as set forth above. The simulation data discussed below were created using ICEPIC (Improved Concurrent Electromagnetic Particle-in-Cell) code, a numerical approach for evaluation of high power microwave tube designs. The ICEPIC algorithm solves Maxwell's equations and the relativistic Lorentz force law in the time domain on a fixed staggered grid.

Magnetron Design Performance

Figure 3:
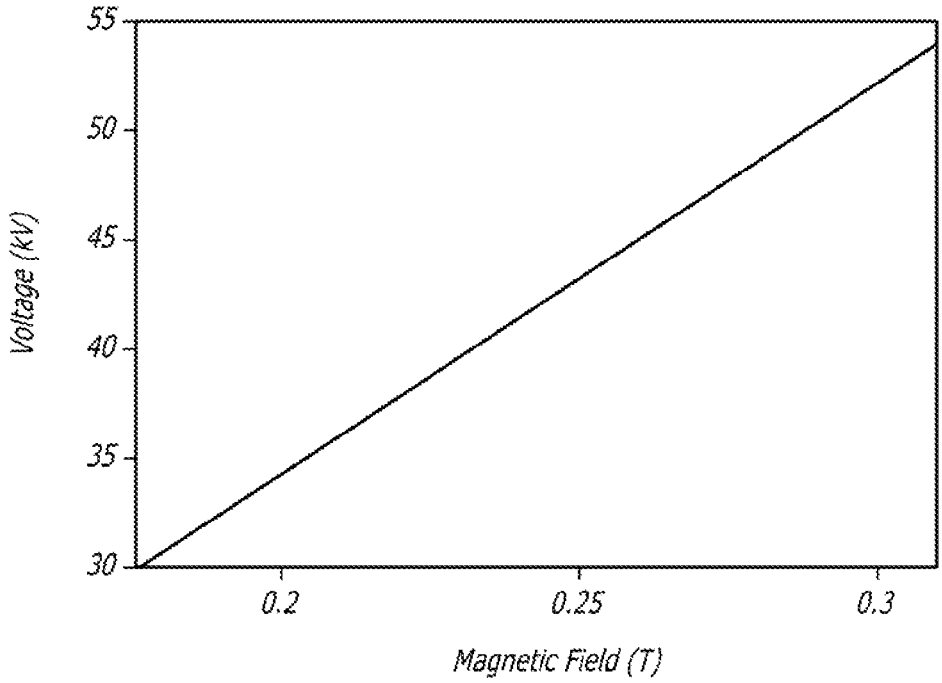
FIG. 3 is a graph that illustrates π mode resonance for a magnetron in accordance with the invention operating at 912 MHz.

FIG. 3 is a graph that illustrates π mode resonance for a magnetron in accordance with the invention operating at 912 MHz Oscillations in the π mode typically occur right above the Buneman-Hartee π mode curve and, thus, the simulations described below target this region of the voltage-magnetic field parameter space.

For the simulations, a resolution of one grid cell length was used that was equal to 0.0508 cm on a uniform Cartesian grid. With the cathode radius at 2.2 cm and the vane tips at 3.0 cm, the interaction region was resolved at 16 grid cells. At this resolution, the grid volume was 590, 590 and 817 cells in the x, y and z directions respectively, yielding a total of approximately 284 million grid points. Simulations produce approximately 7 million charged micro-particles, requiring large high performance computing resources. The simulations of the magnetron described below were carried out on three different parallel computing platforms using 256, 2.6 GHz quad core Intel Hehalem CPU's, 256 2.7 GHz AMD Opteron CPU's, and 256 2.8 GHz Intel Xeon CPU's. Each simulation required approximately 2.5 days to reach 1.5 μs of simulation time at which time saturation was well established.

A pulsed power device was used to provide diode voltage. The circuit and switches that constitute the pulsed power device are not modeled here, rather, a time dependent voltage function was used to emulate the pulsed power source. The voltage function was continuous, consisting of a first part (a 50 ns linear ramp-up) followed by a second part that is a constant voltage amplitude lasting for the duration of the simulation. Voltages for the simulations ranged from 32 to 56 kV.

A uniform axial magnetic field existed for the duration of the simulations. Such field represented the insulating magnetic field that current carrying coils generate in the experiment. The coils produce a magnetic field that is uniform in the interaction region and throughout most of the magnetron.

Five sets of simulations were carried out. The magnetron was simulated at magnetic fields of 0.18 T, 0.2 T, 0.225 T, 0.25 T and 0.275 T. The voltage range examined at each magnetic field was approximately 6 kV in 500 V increments. A total of 65 simulations were carried out.

Results of Magnetron Simulation

Figure 4:
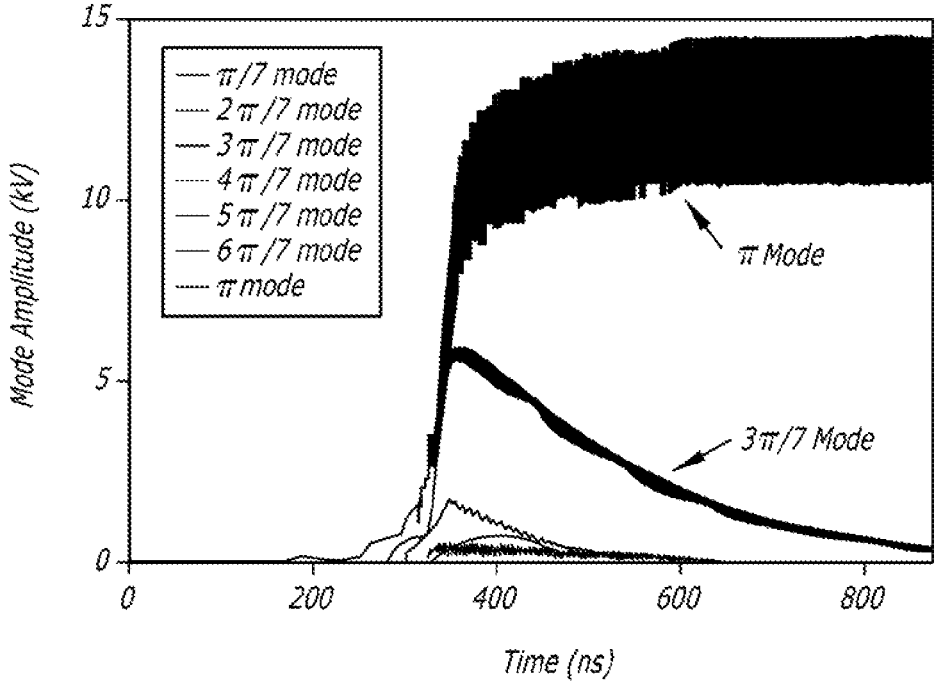
FIG. 4. is a graph for illustrating the evolution of magnetron modes during a simulation of the magnetron of the invention.

FIG. 4 is a graph for illustrating the evolution of magnetron modes, utilizing V=42.0 kV at B=0.2 T as reference simulation. As can be seen, there exists a transient period of mode competition primarily due to the $3\pi/7$ mode during the ascent of the $\pi$ mode. Although the magnetron has locked into the desired $\pi$ mode by 400 ns, mode competition remains until about 700 ns. After this time mode competition is confined to amplitudes less than 1 kV for each competing mode with the amplitude of the $3\pi/7$ mode quickly decaying. The $\pi$ mode remains the dominant mode for the duration of the simulation.

Figure 5:
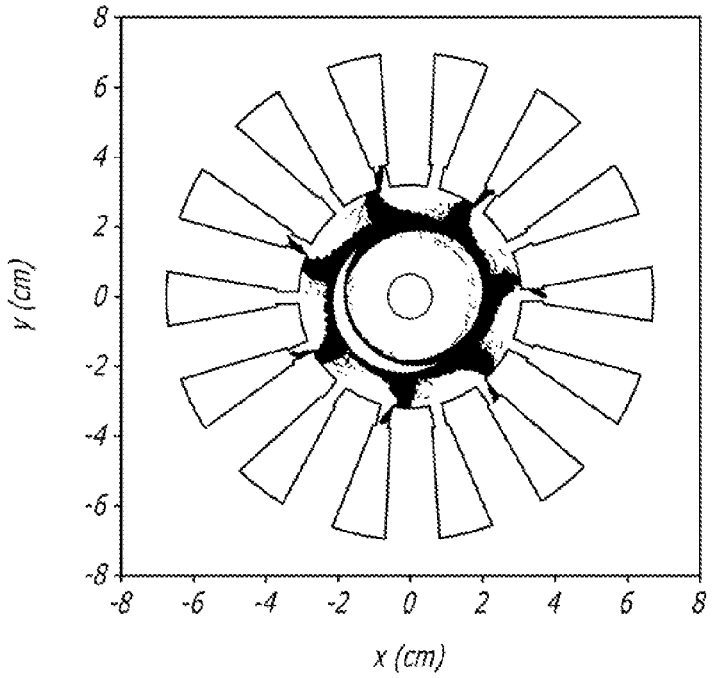
FIG. 5 is a cross-sectional view of the invention with particles of a particle-in-cell simulation illustrated by corresponding dots.

FIG. 5 is a cross-sectional view of the magnetron of the invention with particles of the simulation illustrated thereon by corresponding dots. This view illustrates the representative simulation at 800 ns. Seven particle spokes, characteristic of the $\pi$ mode in a fourteen vane magnetron are clearly evident.

RF output power is evaluated via the area integral of the outward Poynting flux. This integral covers all six coaxial RF outputs. This plane of integration is located at z=14.0 cm. RF output power at saturation was about 1.39 MW. Output power efficiency is defined as the ratio of radiated power to system input power. Input power is given by P=IV, where I is the input current supplied to the cathode and V is the upstream diode voltage. This current is calculated by performing a closed path line integral of the magnetic field around the area in which the current is flowing to determine the current and integrating the electric field radially to determine the voltage. For the simulation, RF power efficiency was 87.1 percent with an input current of 38.5 A and a measured voltage of 41.4 kV. There was no downstream leakage current. For a strapped magnetron operating at the MW power level there is concern about breakdown due to field stress. The Kilpatrick limit for breakdown in a magnetron using a copper anode operating at 912 MHz is approximately 284 kV/cm. A survey of electrical field data at saturation throughout the volume of the magnetron indicates that the critical location for breakdown is the downstream straps. Consequently a thorough examination of field stresses at this location was carried out. Field stress data at the straps was produced at every time step for two different times and extending over 50 oscillatory periods during saturation, one starting at 800 ns and the other at 850 ns. Results indicate that the axial electric field component peaks at 259 kV/cm and that the radial electric field component peaks at 346 kV/cm. (It should be noted that the axial magnetic field of B=0.2 T will act to insulate any charge flow along this direction, easily mitigating breakdown.)

The V=42 kV at B=0.2 T simulation ran at 87.1 percent efficiency, most of the remaining energy went into heating both the cathode and the anode slow wave structure. Simulations were equipped with diagnostic capability to record the kinetic energy of charged particles upon their impact with the cathode, anode slow wave structure or upstream/downstream structure. Impact data was taken during saturation at 850 ns at each time-step over one cycle to yield an approximate result for the character of energy deposition at saturation. Power loss to the cathode via back bombardment is approximately 3.4 percent of the total input power (i.e. approximately 53 kV). The heat burden may be mitigated by operating at a 5 percent duty cycle, in which case 2.65 kW heating results. Analysis indicates that a Tungsten cathode is capable of supporting this magnitude of heating. Power loss due to collisions with the anode slow wave structure is approximately 101 kW or 6.3 percent of input power. At a 5 percent duty cycle this yields approximately 5 kW, a rate of heating this is readily addressed by external cooling mechanisms.

The described simulation is representative of a battery of runs performed from B=0.18 T to B=0.275 T. A minor degree of mode competition present at startup, which may occur between 350 and 700 ns, is well on its way to decay once $\pi$ mode saturation has been reached. The simulated magnetron operated in accordance with the Buneman-Hartee resonance condition. Operation was robust and predictable over the range of magnetic fields and voltages sampled. The voltage window for $\pi$ mode oscillation for a given magnetic field was approximately 6 kV which advances performance stability.

Figure 6:
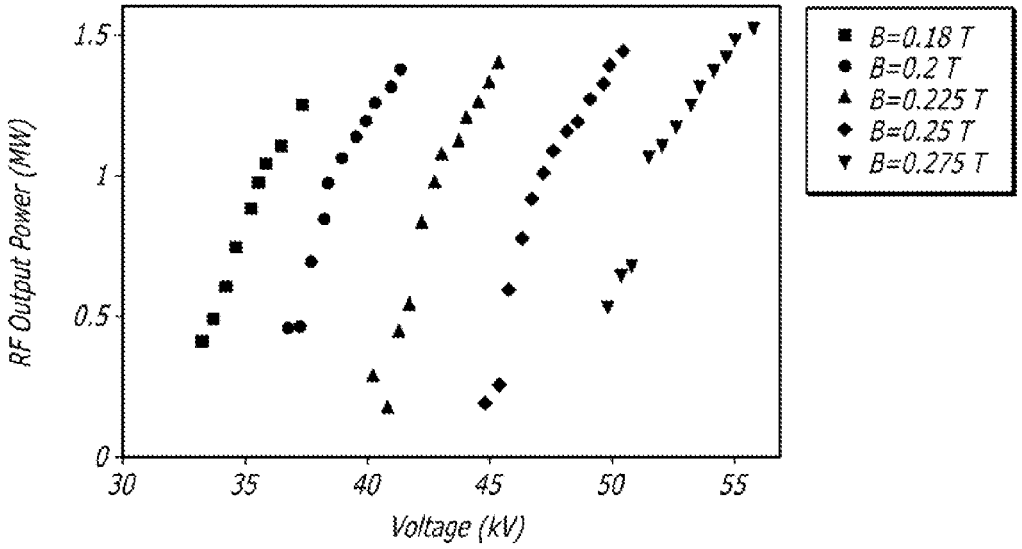
FIG. 6 is a graph of output power generated by all π mode simulations of the magnetron of the invention.

FIG. 6 is a graph that displays the output power generated by all $\pi$ mode simulations of the magnetron of the invention. At approximately 36 kV RF power exceeds 1 MW. Power levels for voltages this low represent a significant improvement over current technologies. Little variation in efficiency was observed, ranging from 83 to 87.7 percent with the highest values of efficiency occurring for the highest voltages at a given magnetic field. Input currents remained below 40 A for all simulations.

Figure 7:
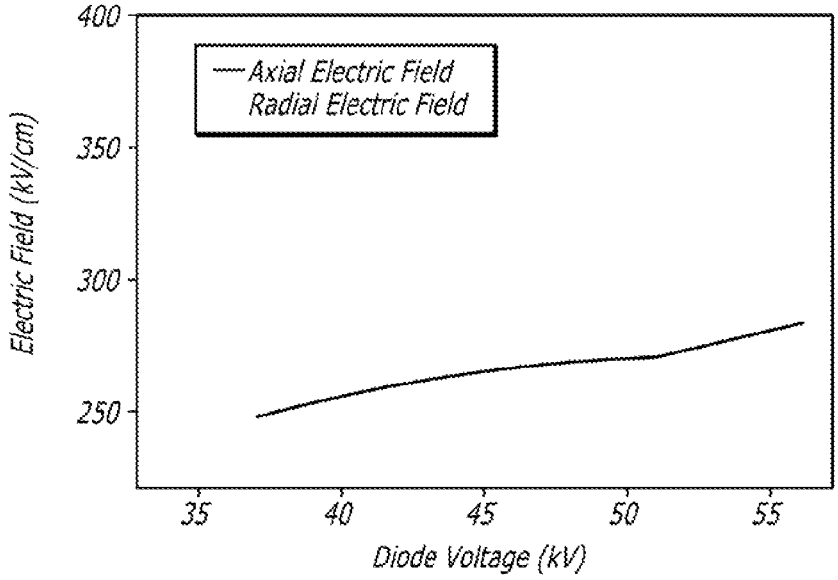
FIG. 7 is a graph illustrating radial and axial electric fields over simulations of a magnetron in accordance with the invention.

FIG. 7 is a graph illustrating radial and axial electric fields within the magnetron over all simulations. Field stress maxima were examined for simulations yielding peak RF power outputs for each magnetic field. Field stress was recorded for 50 oscillations starting, well into saturation, at 850 ns. As with the reference simulation, the downstream straps were identified as a location for high field stress. As can be observed from FIG. 7, the axial component of the electric field never exceeded the Kilpatrick limit for all magnetic fields examined. This was true even for the simulations with RF output power exceeding 1.4 MW. The radial component of the electric field did exceed Kilpatrick limit for all peak RF simulations examined. However, as noted above, this value is mitigated due to the presence of the insulating magnetic field.

Figure 8:
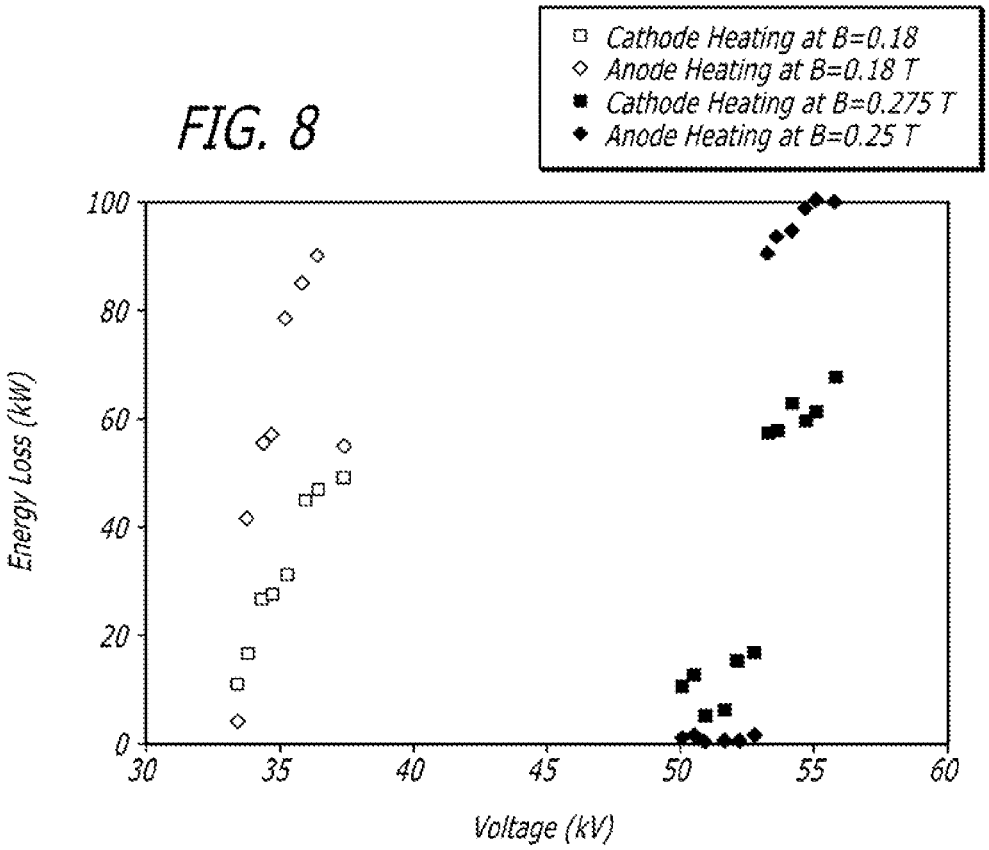
FIG. 8 is a graph illustrating energy loss in simulations of a magnetron in accordance with the invention.

Heating of the cathode and anode was measured at saturation for all simulations. For clarity, the simulation data for only the B=0.18 and B=0.275 T are illustrated in FIG. 8, a graph illustrating energy loss in simulations of a magnetron in accordance with the invention. The two sets of simulations represent the minimum and maximum values for both cathode and anode heating. As with the reference simulation, heating rates were determined by calculation of energy loss due to particle collisions with the anode slow wave structure and the cathode. Diagnostics were placed around the slow wave structure and the cathode for recording particle kinetic energy upon collision with the slow wave structure. Separate diagnostics were put in place so that particle kinetic energy could be recorded when the particle was back scattered into the cathode. Cathode heating ranged from about 10 kW at B=0.18 T to 66 kW at B=0.275 T. Heating of the slow wave structure ranged from about 1 kW to about 100 kW both for B=0.275. The great variation in heating, for a given magnetic field, as the voltage is increased, is to be expected due to the smaller number of particles impacting the anode slow wave structure at lower voltage. No downstream current loss was detected in any of the simulations.

The magnetron consistently oscillated, in simulation, in the $\pi$ mode across a wide range of magnetic fields and voltages. It operated in a predictable fashion obeying the Buneman- Hartree resonance condition. The π mode resonance curve was used to successfully predict where in voltage/magnetic field space the magnetron would oscillate (i.e. oscillations tracked well with the curve).

Thus it is seen that the present invention provides a high efficiency, 87 percent conventional megawatt class magnetron. The magnetron has been demonstrated in simulation to be capable of supporting π mode oscillations over a 6 kV wide window absent any significant mode competition at output RF power levels that exceed 1 MW for voltages lower than 40 kV. No downstream current loss occurred and RF field amplitudes do not exceed the vacuum breakdown threshold. A magnetron capable of generating over a megawatt of RF output power near L-band at 87 percent efficiency for diode voltages below 45 kV, due to its high output power and minimum voltage requirements, allows the delivery of microwave induced effects over a much wider range of space than otherwise provided in the art.

While this invention has been described with reference to its presently preferred embodiment, it is not limited thereto. Rather, the invention is limited only insofar as it is defined by the following set of patent claims and includes within its scope all equivalents thereof.

KEY TO ELEMENT REFERENCE LIST

10 Magnetron
12 Upstream end
14 Cylindrical core of waveguide
16 Coaxial waveguide
18 Exterior layer of waveguide
19 Annular upstream chamber
20 Disk-shaped flange
22 Interior reflector chamber
24 Downstream slow wave structure
26 Upstream endcap chamber
28 Downstream endcap chamber
29 Interaction region
30 Cathode
32 Central support cylinder
34 Anode slow wave structure
36-62 Vanes (14)
64-90 Resonant cavities
92 Neck
94 Wedge
96 Interaction region
98-108 Waveguide/extractors
110 Center axis
112-118 Straps
119 Inner Surface
120 Downstream wall

What is claimed is:

1. A magnetron for delivering megawatt power at a non-relativistic diode voltage, said magnetron comprising, in combination:

a) an upstream coaxial waveguide comprising a central core and a surrounding exterior layer separated by an annular void defining an upstream chamber, said waveguide being electrically coupled to an adjoining downstream slow wave structure;

b) said slow wave structure including: (i) a rod-shaped central supporting cylinder; (ii) a helical cathode comprising fourteen turns, the axis of said cathode being coaxial with that of said supporting cylinder; (iii) an anode slow wave structure, said anode slow wave structure being coaxial with and surrounding said supporting cylinder and separated therefrom by a void defining a downstream interaction region; and (iv) said anode structure comprising fourteen interiorly-directed vanes defining fourteen resonance cavities therebetween, with each of said resonance cavities comprising a wedge portion adjoined to a neck portion.

2. A magnetron as defined in claim 1 further including:

a) a disk-shaped flange surrounding said coaxial waveguide; and b) said flange having an interior reflector chamber in communication with said upstream chamber.

3. A magnetron as defined in claim 2 further including:

a) a concentric pair of straps, each of said straps being received in notches provided at opposed ends of said vanes;

b) one strap of each pair electrically connecting seven alternating vanes; and c) one strap of each pair electrically connecting said other alternating vanes; and d) said straps of each pair being separated by a predetermined distance.

4. A magnetron as defined in claim 3 further including a plurality of cylindrical energy extractors, each of said extractors being fixed to the downstream edge of one of said vanes.

5. A magnetron as defined in claim 4 comprising six energy extractors.

6. In a magnetron of the type that includes an upstream coaxial waveguide electrically coupled to an adjoining downstream slow wave structure, the improvement comprising, in combination:

a) said slow wave structure including: (i) a rod-shaped central supporting cylinder; (ii) a helical cathode comprising fourteen turns, the axis of said cathode being coaxial with that of said supporting cylinder; (iii) an anode slow wave structure, said anode slow wave structure being coaxial with and surrounding said supporting cylinder and separated therefrom by a void defining a downstream interaction region; and (iv) said anode structure comprising fourteen interiorly-directed vanes defining fourteen resonance cavities therebetween, with each of said resonance cavities comprising a wedge portion adjoined to a neck portion whereby said magnetron is capable of providing megawatt power at a non-relativistic diode voltage.

7. A magnetron as defined in claim 6 wherein said anode slow wave structure further includes:

a) a concentric pair of straps, each of said straps being received in notches provided at opposed ends of said vanes;

b) one strap of each pair electrically connecting seven alternating vanes; and c) one strap of each pair electrically connecting said other alternating vanes; and d) said straps of each pair being separated by a predetermined distance.

* * * * *